US007013644B2

(12) United States Patent
Radcliff et al.

(10) Patent No.: US 7,013,644 B2
(45) Date of Patent: Mar. 21, 2006

(54) ORGANIC RANKINE CYCLE SYSTEM WITH SHARED HEAT EXCHANGER FOR USE WITH A RECIPROCATING ENGINE

(75) Inventors: Thomas D. Radcliff, Vernon, CT (US); Bruce P. Biederman, West Hartford, CT (US)

(73) Assignee: UTC Power, LLC, South Windsor, CT (US)

( * ) Notice: Subject to any disclaimer, the term of this patent is extended or adjusted under 35 U.S.C. 154(b) by 61 days.

(21) Appl. No.: 10/716,300

(22) Filed: Nov. 18, 2003

(65) Prior Publication Data

US 2005/0103016 A1 May 19, 2005

(51) Int. Cl.
*F02G 3/00* (2006.01)

(52) U.S. Cl. ..... 60/614; 60/651; 60/671

(58) Field of Classification Search ..... 60/614, 60/616, 618, 649, 651, 671
See application file for complete search history.

(56) References Cited

U.S. PATENT DOCUMENTS

| | | | | |
|---|---|---|---|---|
| 4,057,715 | A * | 11/1977 | Jones et al. | 700/290 |
| 4,386,499 | A | 6/1983 | Raviv et al. | |
| 4,590,384 | A | 5/1986 | Bronicki | |
| 4,617,808 | A | 10/1986 | Edwards | |
| 4,760,705 | A | 8/1988 | Yogev et al. | |
| 4,901,531 | A * | 2/1990 | Kubo et al. | 60/618 |
| 5,038,567 | A | 8/1991 | Mortiz | |
| 5,056,315 | A * | 10/1991 | Jenkins | 60/614 |
| 5,119,635 | A | 6/1992 | Harel | |
| 5,339,632 | A | 8/1994 | McCrabb et al. | |
| 5,598,706 | A | 2/1997 | Bronicki et al. | |
| 5,632,143 | A | 5/1997 | Fisher et al. | |
| 5,640,842 | A * | 6/1997 | Bronicki | 60/39.181 |
| 5,664,419 | A | 9/1997 | Kaplan | |
| 5,761,921 | A * | 6/1998 | Hori et al. | 62/238.4 |
| 5,809,782 | A | 9/1998 | Bronicki et al. | |
| 5,860,279 | A | 1/1999 | Bronicki et al. | |
| 6,009,711 | A | 1/2000 | Kreiger et al. | |
| 6,101,813 | A | 8/2000 | Sami et al. | |
| 6,497,090 | B1 | 12/2002 | Bronicki et al. | |
| 6,526,754 | B1 | 3/2003 | Bronicki | |
| 6,539,718 | B1 | 4/2003 | Bronicki et al. | |
| 6,539,720 | B1 | 4/2003 | Rouse et al. | |
| 6,539,723 | B1 * | 4/2003 | Bronicki et al. | 60/774 |
| 6,571,548 | B1 | 6/2003 | Bronicki et al. | |
| 2002/0148225 | A1 | 10/2002 | Lewis | |

(Continued)

FOREIGN PATENT DOCUMENTS

| | | |
|---|---|---|
| DE | 26 39 187 | 8/1976 |

(Continued)

*Primary Examiner*—Hoang Nguyen
(74) *Attorney, Agent, or Firm*—Wall Marjama & Bilinski LLP

(57) ABSTRACT

In order to effectively extract the waste heat from a reciprocating engine, the normal heat exchanger components of an engine are replaced with one or more heat exchangers which have the motive fluid of an organic rankine cycle system flowing therethrough. With the heat transfer in the plurality of heat exchangers, the engine is maintained at a reasonable cool temperature and the extracted heat is supplied to an ORC turbine to generate power. The heat is derived from a plurality of sources within the reciprocating engine, and at least two of those sources have their fluids passing through the same heat exchanger. In one embodiment, the engine coolant and the engine lubricant pass through the heat exchanger in the same direction, and the ORC motive fluid passes therethrough in a counterflow relationship.

14 Claims, 2 Drawing Sheets

U.S. PATENT DOCUMENTS

| | | | | |
|---|---|---|---|---|
| 2003/0029169 | A1 | 2/2003 | Hanna et al. | |
| 2003/0089110 | A1 | 5/2003 | Niikura et al. | |
| 2003/0167769 | A1 | 9/2003 | Bharathan et al. | |
| 2003/0218385 | A1 | 11/2003 | Bronicki | |
| 2004/0088993 | A1 * | 5/2004 | Radcliff et al. | 60/772 |
| 2004/0255587 | A1 | 12/2004 | Radcliff et al. | |

FOREIGN PATENT DOCUMENTS

| | | |
|---|---|---|
| DE | 19630559 | 1/1998 |
| DE | 19907512 | 8/2000 |
| DE | 10029732 | 1/2002 |
| EP | 1243758 | 9/2002 |
| JP | 52046244 | 4/1977 |
| JP | 54045419 | 4/1979 |
| JP | 54060634 | 5/1979 |
| JP | 55091711 | 7/1980 |
| JP | 58088409 | 5/1983 |
| JP | 58122308 | 7/1983 |
| JP | 59043928 | 3/1984 |
| JP | 59054712 | 3/1984 |
| JP | 59063310 | 4/1984 |
| JP | 59138707 | 8/1984 |
| JP | 59158303 | 9/1984 |
| JP | 60158561 | 8/1985 |
| JP | 06088523 | 3/1994 |
| JP | 2002266655 | 9/2002 |
| JP | 2002285805 | 10/2002 |
| JP | 2002285907 | 10/2002 |
| JP | 2003061114 | 6/2003 |
| JP | 2003161101 | 6/2003 |
| WO | 98/06791 | 2/1998 |
| WO | 02/099279 | 12/2002 |
| WO | 03/078800 | 9/2003 |

* cited by examiner

ORGANIC RANKINE CYCLE SYSTEM WITH SHARED HEAT EXCHANGER FOR USE WITH A RECIPROCATING ENGINE

BACKGROUND OF THE INVENTION

This invention relates generally to waste heat recovery systems and, more particularly, to an organic rankine cycle system for extracting heat from a reciprocating engine.

Power generation systems that provide low cost energy with minimum environmental impact, and which can be readily integrated into the existing power grids or which can be quickly established as stand alone units, can be very useful in solving critical power needs. Reciprocating engines are the most common and most technically mature of these distributed energy resources in the 0.5 to 5 MWe range. These engines can generate electricity at low cost with efficiencies of 25% to 40% using commonly available fuels such as gasoline, natural gas or diesel fuel. However, atmospheric emissions such as nitrous oxides (NOx) and particulates can be an issue with reciprocating engines. One way to improve the efficiency of combustion engines without increasing the output of emissions is to apply a bottoming cycle (i.e. an organic rankine cycle or ORC). Bottoming cycles use waste heat from such an engine and convert that thermal energy into electricity.

Most bottoming cycles applied to reciprocating engines extract only the waste heat released through the reciprocating engine exhaust. However, commercial engines reject a large percentage of their waste heat through intake after-coolers, coolant jacket radiators, and oil coolers. Accordingly, it is desirable to apply an organic rankine bottoming cycle which is configured to efficiently recover the waste heat from several sources in a reciprocating engine system.

It is therefore an object of the present invention to provide an improved ORC waste heat recovery system.

Another object of the present invention is the provision for extracting waste heat from a number of sources from a reciprocating engine.

Yet another object of the present invention is the provision for employing an ORC for recouping waste heat from a reciprocating engine.

Still another object of the present invention is the provision for recovering waste heat from a number of sources of a reciprocating engine in an effective and economical manner.

These objects and other features and advantages become more readily apparent upon reference to the following description when taken in conjunction with the appended drawings.

SUMMARY OF THE INVENTION

Briefly, in accordance with one aspect of the invention, staged heat exchangers serve the dual purpose of removing heat from the intake tract, water cooling jacket, oil sump, and exhaust gas cooler of a reciprocating engine while preheating and boiling the working fluid of an organic rankine cycle.

In accordance with another aspect of the invention, the usual heat exchanger apparatus in a reciprocating engine (i.e. primarily the transfer of heat to ambient air) is replaced with a set of heat exchangers wherein the heat is transferred to an ORC fluid, with the temperatures being progressively increased.

By yet another aspect of the invention, provision is made for the sharing of a single heat exchanger that simultaneously receives heat from the engine coolant and from the engine oil sump, and transfers the heat to an ORC working fluid.

by still another aspect of the invention the flow of engine coolant and engine oil is made to flow in one direction within a heat exchanger and the ORC fluid is made to flow in a counterflow direction.

In the drawings as hereinafter described, a preferred embodiment is depicted; however, various other modifications and alternate constructions can be made thereto without departing from the true spirit and scope of the invention.

DETAILED DESCRIPTION OF THE INVENTION

Figure 1:
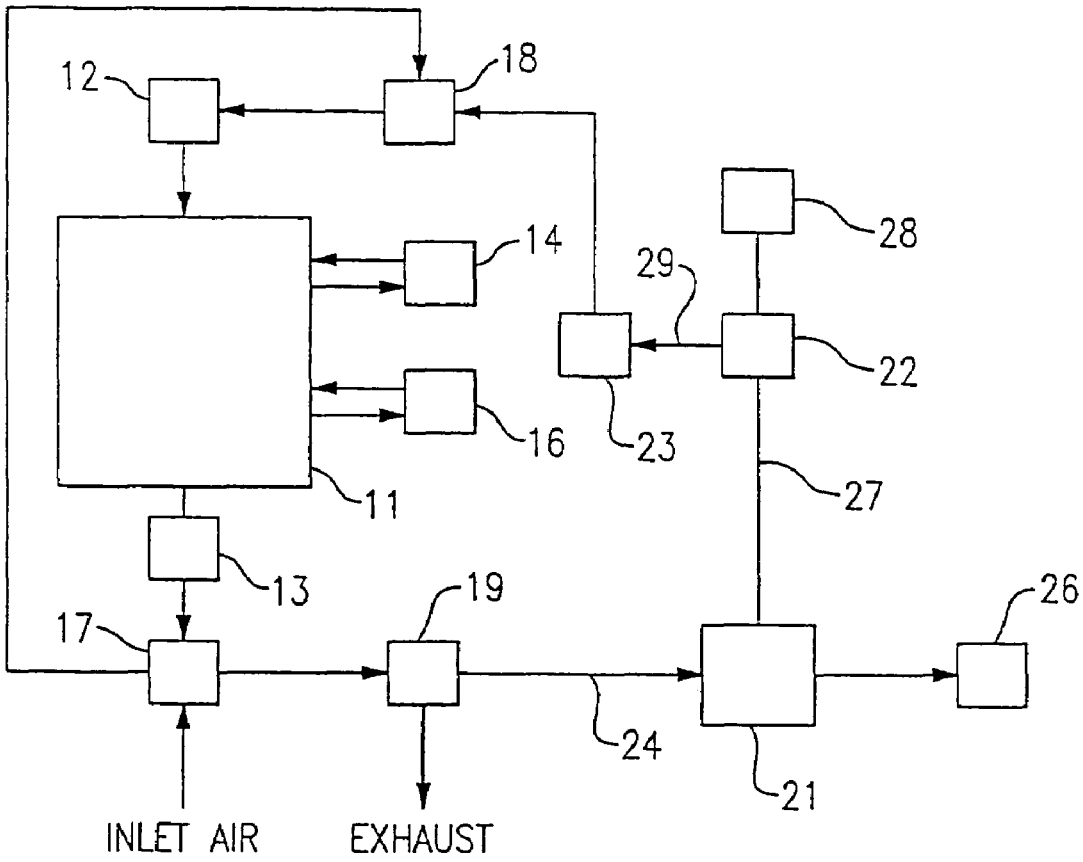
FIG. 1 is a schematic illustration of an organic rankine cycle system as incorporated with a reciprocating engine.

Referring now to FIG. 1, there is shown a reciprocating engine 11 of the type which is typically used to drive a generator (not shown) for purposes of providing electrical power for consumer use. The engine 11 has an air intake section 12 for taking in air for combustion purposes and an exhaust 13 which may be discharged to the environment, but is preferably applied to convert a portion of the energy therein to useful purposes. The engine 11 also has a plurality of heat exchangers with appropriate fluids for maintaining the engine 11 at acceptable operating temperatures.

One of the heat exchangers is a replacement heat exchanger 14 that transfers heat from a liquid coolant that is circulated in heat exchange relationship with the portion of the engine where combustion occurs, to an ORC working fluid. That is, the typical engine coolant-to-ambient air radiator of the reciprocating engine is replaced with a liquid-to-liquid (i.e. engine coolant-to-organic working fluid) heat exchanger. This heat exchanger is much smaller, and thus cheaper then the replaced radiator because it has forced liquid convection heat transfer on both sides of the heat exchanger. Also, the engine coolant and the ORC liquid pumps provide the forced convection on each side, so no energy and space consuming fans would be required as on a typical radiator.

Similarly, an oil cooler 16 is provided to remove heat from a lubricant that is circulated within the moving parts of the engine 11 and to transfer that heat to the ORC working fluid. A typical oil-to-ambient air or oil-to-engine coolant heat exchanger is replaced by an oil-to-ORC fluid heat exchanger to further recover waste heat from the engine at a higher temperature than the engine coolant of the radiator while preventing oil overheating.

The engine 11 may be provided with a turbo charger 17 which receives high temperature, high pressure exhaust gases from the exhaust section 13 to compress the engine inlet air entering the turbo charger 17. The resulting compressed air, which is heated as a result of the compression process, then passes to a charge cooler 18 prior to passing into the intake 12 of the engine to be mixed with fuel for combustion. The charge cooler 18 is an air-to-liquid charge cooler that replaces the typical intake air-to-ambient air or intake air-to-engine coolant after-cooler that is normally applied on turbocharged or turbo-compounded reciprocating engines. If the heat exchanger were the same size, it would provide a cooler intake charge to the engine because the working fluid of the ORC would be at a lower temperature then the regulated engine coolant (air to coolant after cooling), or because the temperature difference between the air and the liquid working fluid would be less then that between two air streams (air to air after cooler).

The exhaust gases, after passing through the turbo charger 17, pass through an evaporator 19, which transfers waste heat from the exhaust gases to the multi-phase working fluid of the ORC where it is superheated.

In addition to the evaporator 19, the ORC includes a turbine 21, a condenser 22 and a pump 23. The turbine 21 receives the superheated refrigerant gas along line 24 from the evaporator 19 and responsively drives a generator 26. The resulting low energy vapor then passes along line 27 to the condenser 22 to be condensed to a liquid form by the cooling effect of fans 28 passing ambient air thereover. The resulting liquid refrigerant then passes along line 29 to the pump 23 which causes the liquid refrigerant to circulate through the engine 11 to thereby generate high pressure vapor for driving the turbine 21, while at the same time cooling the engine 11. Both the fans 28 and the pump 23 are driven by electrical power from the grid 31.

As will be seen in FIG. 1, relatively cool liquid refrigerant from the pump 23 passes sequentially through ever increasing temperature components of the engine 11 for providing a cooling function thereto. That is, it passes first through the charge cooler 18, where the temperature of the liquid refrigerant is raised from about 100° to 130°, after which it passes to the heat exchanger 14, where the refrigerant temperature is raised from 130° to 150°, after which is passes to an oil cooler 16 where the refrigerant temperature is raised from 150° to 170°. Finally, it passes through the evaporator 19 where the liquid is further preheated before being evaporated and superheated prior to passing on to the turbine 21.

Figure 2:
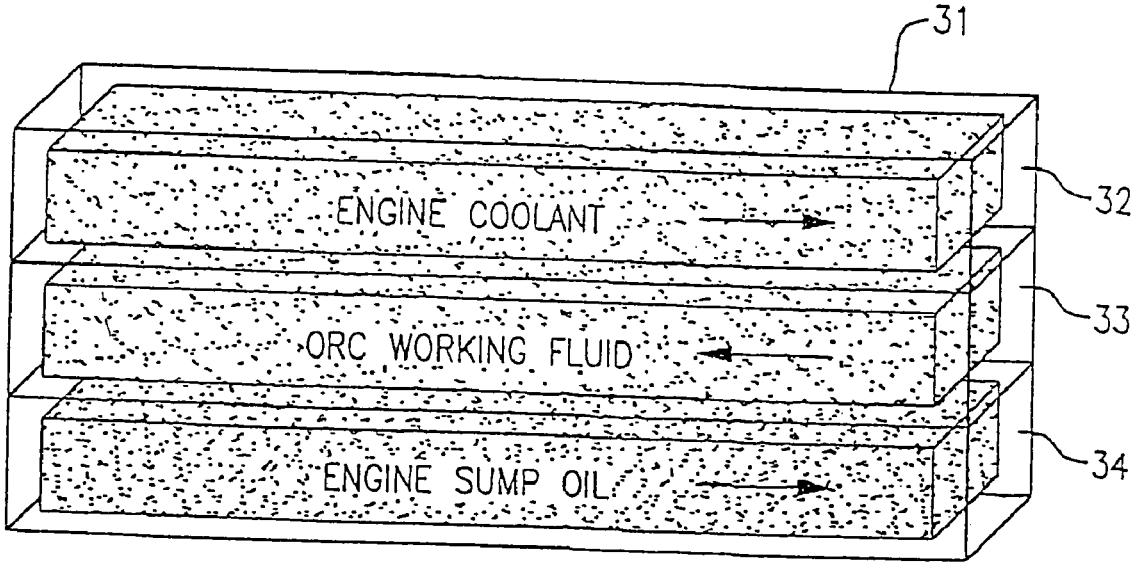
FIG. 2 is a schematic illustration of a shared heat exchanger in accordance with the present invention.

Recognizing now that the replacement of each of the four heat exchangers in a conventional turbocharged reciprocating engine can be relatively expensive, an alternative, cost saving, approach is shown in FIG. 2 wherein the functions of two of the heat exchangers are combined into a single heat exchanger 31. The heat exchanger has three compartments 32, 33 and 34 as shown. Compartments 32 and 34 are adapted for the simultaneous flow of the respective engine coolant and engine sump oil in the same direction as shown. The ORC working fluid on the other hand, flows in a counterflow direction within the compartment 33 such that the heat from each of the engine coolant and engine sump oil are simultaneously transferred to the ORC working fluid. Such a combined function is made possible by the fact that the engine coolant and the engine sump oil are at about the same temperature (i.e. in the range of 160 to 200° F.). The ORC working fluid is at a temperature of around 130 coming into the heat exchanger 31 and after passing therethrough will be in the range of 170. In this way, a single heat exchanger can replace the relatively large liquid-to-air heat exchangers and their associated fans with considerable reduction in cost.

As described hereinabove, the specific combination of heat exchangers are to be designed to get the lowest cost per unit power generated by the combined engine/ORC system by maximizing the heat exchanger size to reduce cost while minimizing engine intake temperature and maximizing ORC fluid temperature to improve the engine and ORC cycle efficiencies.

While the invention has been shown and described with respect to a preferred embodiment thereof, it should be understood by those skilled in the art that the foregoing and various other changes, omissions and additions in the form of a detail thereof made be made without departing from the true sprit and scope of the invention as set forth in the following claims.

We claim:

1. An energy recovery system of the type wherein heat is extracted from an engine by refrigerant passing through an heat exchanger of an organic rankine cycle system, comprising:

a single heat exchanger for transferring heat from said engine to an organic rankine cycle fluid flowing through said heat exchanger;

a turbine for receiving said heated fluid from said heat exchanger and for transferring a thermal energy to motive power, with said fluid being cooled in process;

a condenser for receiving said cooled fluid and for further cooling said fluid to cause it to change to a liquid state;

a circulation means for receiving said liquid refrigerant and circulating it to said single heat exchanger;

wherein said single heat exchanger is adapted to transfer heat from a plurality of sources within said engine.

2. A system as set forth in claim 1 wherein said single heat exchanger is adapted to conduct the flow of two different engine fluids therethrough.

3. A system as set forth in claim 2 wherein said single heat exchanger is so adapted as to have engine coolant passing therethrough.

4. A system as set forth in claim 2 wherein said single heat exchanger is so adapted as to have engine lubricant passing therethrough.

5. A system as set forth in claim 2 wherein the flow of said two different engine fluids is in the same direction through said single heat exchanger.

6. A system as set forth in claim 5 wherein said ORC flow is in a direction opposite to said two different engine fluid flows.

7. A system as set forth in claim 2 wherein the temperature of said two different engine fluids are in the range of -to-□ F.

8. A system as set forth in claim 2 wherein said two different engine fluids comprise an engine coolant and an engine lubricant.

9. A method of operating a waste heat recovery system having an organic rankine cycle with its motive fluid in heat exchange relationship with relatively hot fluids of an engine, comprising the steps of:

circulating a relatively cool motive fluid from a condenser of said organic rankine cycle through at least one heat exchanger;

circulating a plurality of relatively hot fluids from said engine through said at least one heat exchanger to thereby heat said motive fluid and cool said plurality of fluids;

circulate said heated motive fluid through a turbine for providing motive power thereto while cooling said motive fluid;

circulating said cooled motive fluid to said condenser; and circulating said plurality of cooled engine fluids back to said engine.

10. A method as set forth in claim 9 wherein said step of circulating a plurality of relatively hot fluids includes the step of circulating engine coolant through said at least one heat exchanger.

11. A method as set forth in claim 9 wherein said step of circulating a plurality of relatively hot fluids includes the step of circulating engine lubricant through said at least one heat exchanger.

12. A method as set forth in claim 9 wherein said at least one heat exchanger comprises a single heat exchanger and further wherein said step of circulating a plurality of relatively hot fluids includes the step of circulating an engine coolant and an engine lubricant through said single heat exchanger.

13. A method as set forth in claim 12 wherein said engine coolant and engine lubricant are made to flow through said single heat exchanger in the same direction.

14. A method as set forth in claim 13 wherein said step of circulating said relatively cool motive fluid is accomplished by causing said motive fluid to flow in a direction opposite to the flow of said engine coolant and engine lubricant.

* * * * *

UNITED STATES PATENT AND TRADEMARK OFFICE

CERTIFICATE OF CORRECTION

PATENT NO. : 7,013,644 B2
APPLICATION NO. : 10/716300
DATED : March 21, 2006
INVENTOR(S) : Thomas D. Radcliff et al.

It is certified that error appears in the above-identified patent and that said Letters Patent is hereby corrected as shown below:

Claim 7, column 4 Line 34:
The numbers representing the engine fluid temperature range are missing. Please replace with --160° to 200°F--.

Signed and Sealed this

Nineteenth Day of September, 2006

JON W. DUDAS
*Director of the United States Patent and Trademark Office*